US005121700A

United States Patent [19]

Blackwell et al.

[11] Patent Number: 5,121,700

[45] Date of Patent: Jun. 16, 1992

[54] METHOD AND APPARATUS FOR IMPROVING FLUID FLOW AND GAS MIXING IN BOILERS

[75] Inventors: Brian R. Blackwell, Vancouver; Colin MacCallum, West Vancouver, both of Canada

[73] Assignee: Sandwell, Inc., Vancouver, Canada

[21] Appl. No.: 587,645

[22] Filed: Sep. 24, 1990

Related U.S. Application Data

[63] Continuation of Ser. No. 333,545, Apr. 4, 1989, abandoned.

[30] Foreign Application Priority Data

Apr. 15, 1988 [CA] Canada ..... 564320

[51] Int. Cl.[5] ..... F23D 1/00

[52] U.S. Cl. ..... 110/348; 110/347; 431/175; 431/180

[58] Field of Search ..... 110/348, 297, 314, 245, 110/347, 343, 344; 431/10, 165, 190, 351, 352, 176, 175, 180

[56] References Cited

U.S. PATENT DOCUMENTS

| | | | |
|---|---|---|---|
| 1,473,665 | 11/1923 | Berthelon | 110/297 |
| 2,730,997 | 1/1956 | Birkner | 110/348 |
| 3,048,131 | 8/1962 | Hardgrove | 110/348 |
| 4,246,853 | 1/1981 | Mehta | 110/263 |
| 4,712,491 | 12/1987 | Schmidt | 110/248 |
| 4,744,312 | 5/1988 | Narisoko et al. | 110/346 |
| 4,785,744 | 11/1988 | Fontaine | 110/297 |
| 4,823,710 | 4/1989 | Garrido et al. | 110/297 |

*Primary Examiner*—Henry A. Bennet
*Assistant Examiner*—Denise L. F. Gromada
*Attorney, Agent, or Firm*—Barrigar & Oyen

[57] ABSTRACT

This invention is directed to a method and apparatus for improving fluid flow and gas mixing in boilers. More particularly, this invention pertains to a method and apparatus for improved fluid flow and gas mixing in kraft recovery boilers for increased energy efficiency, reduced TRS emissions and increased capacity. The method of introducing air into a boiler furnace comprises: (a) introducing air through at least one opening located on at least a first wall of the interior of the furnace; and (b) introducing air through at least one second opening located on a second wall of the interior of the furnace opposed to the first wall at the same, or different, elevations. The method of introducing air into a boiler furnace may also comprise: (a) introducing air into the furnace in the form of a first set of small and large jets originating from one wall of the interior of the furnace; and (b) introducing air into the furnace in the form of a second set of small and large jets originating from the wall of the interior of the furnace opposite the first wall. The locations of the sources of the first set of small and large jets may be placed so that they oppose the sources of the second set of small and large jets, with small jets opposing large jets, and vice versa. The sizes of the jets may be regulated by varying opening size, number of openings in groups of openings, air pressure upstream of the openings, or combinations thereof.

38 Claims, 11 Drawing Sheets

METHOD AND APPARATUS FOR IMPROVING FLUID FLOW AND GAS MIXING IN BOILERS

This application is a continuation of Ser. No. 07/333,545 filed on Apr. 4, 1989 and now abandoned.

FIELD OF THE INVENTION

This invention is directed to a method and apparatus for improving fluid flow and gas mixing in boilers. More particularly, this invention pertains to a method and apparatus for improved fluid flow and gas mixing in kraft recovery boilers for increased energy efficiency, decreased odorous TRS emissions and increased capacity to burn liquor from the pulping process.

BACKGROUND OF THE INVENTION

Boilers are widely used to generate steam for numerous applications. In the pulp and paper industries, recovery boilers are used to burn the liquor produced in a kraft pulp making process. Such boilers require combustion air. The current practice for introducing combustion air into the kraft recovery boilers involves injection of the air at two or more elevations in the furnace of the boiler. At the lowest elevation, air is injected through ports in all four walls. At higher elevations, air is injected through ports in all four walls or in two opposite walls of the furnace. The port openings which form the air jets are usually rectangular.

Conventional boiler systems have at least three basic deficiencies:

In some cases, the jet port openings are so small that when upflowing combustion gases in the furnace come from below the openings, an individual jet stream coming from a port does not have enough momentum to enable the jet stream to reach the centre of the furnace before the jet is deflected upwards.

The combustion air is usually injected in such a way that the jet streams of combustion air interfere with each other, and the interference causes upward deflection of the jet streams. Two locations where such interference can occur are at the centre of the furnace, where the jet streams from opposite walls of the furnace may meet head on, if they penetrate before being deflected upwards; and in the corners of the furnace, where the jet streams meet at right angles and interfere with one another.

When jet streams meet head on and are directed upwards, they tend to be repelled somewhat such that there is an isolated space between their paths, and hence there is restricted mixing in these spaces.

Due to the lack of momentum of the jet streams and because of the interference between the jet streams, as described, gas in the centre of the furnace is directed sharply upwards with somewhat of a diverging pattern. The result is a central updraft core of high gas velocity relative to the average upward gas velocity at any one horizontal cross-section of the furnace. This central updraft core begins at the primary air level. The updraft core has associated with it a recirculating downflow by the furnace walls, which adds to the upward velocity of the gas in the centre of the furnace. It has been found that air jets located more than one to two metres above the primary air level have great difficulty penetrating this central updraft core. The chemical composition in this updraft core is unsuitable for thorough combustion because it contains a high concentration of combustibles and little oxygen for combustion.

The primary jets, located at the lowest elevation in the furnace, are the main factor in initiating the recirculating pattern and the adverse central updraft. In essentially all current recovery boiler designs, the primary air is introduced more or less equally through multiple openings in all four walls thereby forming a plane jet stream off each wall. These four plane jet streams meet in the central region of the furnace and rise together. As the jet streams issue from the ports, they entrain surrounding gases. Since the upflow of volatiles from the char bed of the furnace is limited in volume, gases are necessarily drawn down the furnace walls in order to continually replace the gases that are entrained into the upwardly flowing jet streams. This action sets up a recirculating flow pattern in the furnace.

In boilers which have only one air entry level below the liquor spray level, such as older Combustion Engineering-type (CE-type) boilers, the central updraft core has been found to occupy approximately 1/9 of the horizontal cross-sectional area in the lower furnace. This core extends up through the elevation where the liquor spray is introduced. The top of the recirculating pattern occurs some height above the liquor spray level in the boiler, at an elevation corresponding approximately to the uppermost level of air injection in such boilers-designated the tertiary air level for the purposes of this discussion. The air jets introduced at this upper air level have been found to have little influence on the recirculating pattern.

Most boilers with two levels of air entry below the liquor sprayers, such as older Babcock & Wilcox-type (B&W-type) boilers and the newer CE-type boilers, have primary and secondary air ports on all four walls, with the air at a given air level being introduced more or less equally on each wall. The introduction of secondary air more or less equally from all four walls in such boilers reinforces tee detrimental central updraft core phenomenon.

One of the major operational problems in kraft recovery boilers is the formation of fireside deposits on the pendent heat transfer surfaces in the upper part of the boiler. The most troublesome deposits occur in the superheater and the first part of the boiler bank. These deposits are formed mainly by particles that originate from the gas entrainment of some of the liquor spray particles. The mass of a particle that can be entrained in a gas varies with about the sixth power of gas velocity. Therefore, from a conceptual perspective, it is important to minimize gas velocity extremes. As the liquor spray particles fall towards the bottom of the furnace, they swell and lose weight, becoming less dense, and therefore become easier to entrain. Therefore, the most sensitive area for entrainment is at the char bed/primary air entry level of the furnace. A second critical area is where there is a secondary level of air entry just above the char bed. Most of the particles that are entrained upwards into the region above the liquor spray level by the upwardly flowing gases are essentially destined to be carried out of the furnace by the furnace exit gas. Therefore, for the air introduced above the liquor spray level, gas velocity is not as much of a concern relative to minimizing fireside deposition.

Char bed control is a major operational concern with kraft recovery boilers. The char is formed as liquor spray particles burn in the furnace. The char is partially burned in flight, as it falls to the bottom of the furnace, but the last part of the carbon in the char is burned out on top of the char bed that covers the bottom of the furnace. One of the main functions of the primary air jets is to supply the oxygen to burn the char on the surface of the bed. The heterogeneous combustion of the char on the bed is limited by the mass transfer of oxygen, by diffusion. If the primary air jets are ineffective at supplying oxygen to the char, the bed grows in size. When this occurs, the boiler operator increases the temperature and/or pressure of the liquor in the spray guns, so that the liquor spray has smaller particles. With smaller particles more of the char is burned in flight so less has to be burned on the char bed. Increased liquor spray temperature, while it does control the char bed size, has the disadvantage that the smaller spray particles are easier to entrain by the upflowing furnace gases, resulting in an increase in the rate of formation of fireside deposits.

In one recovery boiler retrofit, designed by the inventors, some of the primary air ports were enlarged, to decrease the velocity of the primary air jets, with the intention of minimizing the scouring of char particles off the char bed by the primary air jets. Operating experience on the boiler after the retrofit indicated that low-velocity primary jets are somewhat impractical because they are not as effective at controlling char bed size and shape as high-velocity primary jets. The theory of low-velocity primary jets would be more practical if liquor spray guns produced particles essentially all one size. However, the guns produce a range of particle sizes, from fine to coarse. The large particles presumably cause the problems with control of char bed size. The fine particles are entrained by the furnace gases and are the source of the material that forms the fireside deposits on the heating surfaces in the upper part of the boiler. Both before and after the retrofit, a flat metal bar was inserted into the boiler, in the upper heating surfaces: on removing the bar after a short time, unburned black liquor spray particles were observed. Also, observations with the two char bed imaging cameras after the retrofit indicated that conditions in the lower furnace were quite quiet and there did not seem to be much carryover from the region just above the char bed. Nonetheless, the fireside deposits continued to form. These observations lead to the conclusion that the fine liquor spray particles were the dominant source of material for fireside deposits, rather than particles scoured off the char bed. Furthermore, the fine liquor spray particles seemed to be carried directly upwards. With the low-velocity primary jets, char bed control deteriorated, so higher liquor spray temperatures were required to compensate. Higher liquor temperature caused more fine spray particles and therefore more direct carryover from the liquor spray level. Subsequent to this, the enlarged primary ports were dampened off, thereby forcing the air to the remaining smaller primary ports. This increased the velocity of the air jets from the primary ports remaining open. With the increased velocity of the primary jets, char bed control improved, allowing the liquor temperature to be decreased. In retrospect, the enlarged primary ports were a conceptual error. Rather, it would have been better to use high-velocity primary jets to control the char bed size, thereby allowing a lower liquor temperature and pressure which would generate fewer finer particles, and in turn decrease carryover. Therefore, while low primary jet velocities are indicated theoretically, practical considerations of char bed control make high velocity primary jets more beneficial overall.

Secondary air is provided above the char bed. The function of these air jets is to provide oxygen for the combustion of the volatiles such as carbon monoxide and hydrogen gasified from the liquor spray particles. Here the main concern is to provide the necessary mixing of the combustible gases and the air, while minimizing gas velocity extremes that aggravate the entrainment of liquor spray particles. These jets are not intended to impinge on the char bed, so they do not have a direct char bed control function. Therefore, low velocity is indicated for the secondary air jets.

U.S. Pat. No. 2,416,462 Wilcoxson, discloses a concept involving an interlacing pattern of unopposed jets at the tertiary air level of a furnace (above the liquor sprayers) but it appears such interlacing was done without full appreciation as to the effects of interlacing. No interlacing at the primary and secondary levels of the boiler is disclosed.

Fridley and Barsin [Fridley, M. W. and Barsin, J. A., "Upgrading the Combustion System of a 1956 Vintage Recovery Steam Generator", Tappi Journal , Mar., 1988, page 63 and Fridley, M. W. and Barsin, J. A., "Upgrading a 1956 Vintage Recovery Steam Generator-II", Technical Section, Canadian Pulp and Paper Industry, 1988 Annual Meeting , Montreal] described modifications to an older CE-type boiler in 1986, to implement fully interlaced, unopposed, air jets at the secondary level, below the liquor spray level. There was an improvement in boiler performance. They claimed a decrease in liquor spray carryover. Recent B & W designs of recovery boiler air systems also incorporate this full interlacing of air jets at the secondary level. None of these designs extend interlacing to the primary level.

SUMMARY OF THE INVENTION

The invention pertains to a method of introducing air at a given elevation into a furnace having four walls comprising: (a) introducing air through at least one opening located on a first wall of the interior of the furnace; and (b) introducing air through at least one second opening located on a second wall of the interior of the furnace opposed to the first wall.

In the method, the air may be introduced into the furnace such that it has a horizontal or downward jet stream. The air may be introduced into the furnace through openings in the first and second opposing walls at approximately the same air flow rate, and air may be introduced into the furnace through openings in the third and fourth opposing walls of the furnace at a flow rate lower than the flow rate of the air through the first and second walls.

In the method, the air may be introduced into the furnace at one elevation through the first and second opposing walls at approximately the same air flow rate, and air may be introduced into the furnace through the third and fourth opposing walls of the furnace at a flow rate lower than the flow rate of air through the first and second walls. Air may be introduced into the furnace at a second elevation through the first and second opposing walls at approximately the same air flow rate, and air may be introduced into the furnace through the third and fourth opposing walls of the furnace at a flow rate lower than the flow rate of air through the first and second walls. The boiler can be a kraft recovery boiler.

The invention also pertains to a method of introducing air into a boiler furnace comprising: (a) introducing air into the furnace by means of a first set of small and large jets originating from one wall of the interior of the furnace; and (b) introducing air into the furnace by means of a second set of small and large jets originating from a wall of the interior of the furnace opposite the first wall.

The positions of the first set of jets may be arranged so that a small jet in the first wall opposes a large jet in the opposite wall. The first set of small and large jets may alternate with one another. The second set of small and large jets may alternate with one another.

In the method, a third and fourth set of alternating small and large jets may be located at an elevation in the boiler higher than the first and second set of jets. The first and second set of jets may originate from two opposing walls of the boiler furnace and a third and fourth set of jets may originate from two opposing walls of the boiler furnace other than the walls on which the first and second set of jets originate.

In the method, the first set of jets may be pointed downwardly, horizontally, or slightly upwardly, and the second set of jets may be pointed downwardly, horizontally, or slightly upwardly, into the interior of the furnace. The small and large jets may originate from corresponding small and large ports located in the furnace wall. Alternatively, the small jets may originate from a first group of small ports located in the furnace wall and the large jets may originate from a second group of large ports of similar number to the first group located in the furnace wall. Alternatively, the ports may be of similar size and the large jets may originate from a larger group of ports than do the small jets.

In the method, the ports forming the jets may be similar in size and the large jets may be created by air pressure at a higher level compared with the air pressure used to create the smaller jets.

The jets can be formed by a group of ports similar in size and number and the large jets can be created by air pressure at a higher level compared with the air pressure used to create the smaller jets.

The invention is also directed to a furnace with four walls which utilizes injected air comprising: (a) a furnace chamber; (b) at least one air injection opening located on a first wall of the interior of the furnace; and (c) at least one second air injection opening located on a second wall of the interior of the furnace opposed to the first wall. At least a third air injection opening can be located on a third wall and at least a fourth air injection opening can be located on a fourth wall of the furnace opposed to the third wall.

In the furnace, the air may be injected into the interior of the furnace either horizontally or downwardly. The air may be injected into the furnace through the first and second openings at about the same flow rate, and air may be injected into the furnace through at least one air injection opening located on a third wall of the interior of the furnace, and at least one air injection opening located on a fourth wall of the interior of the furnace at a flow rate lower than the flow rate of the air through the first and second walls.

In the furnace, air may be injected into the furnace at one elevation through openings in the first and second opposing walls at about the same flow rate and at a rate higher than the said flow rate through openings in the third and fourth opposing walls; and air can be injected into the furnace at a second elevation through openings in the first and second opposing walls at about the same flow rate and at a rate higher than the said flow rate through openings in the third and fourth opposing walls.

The invention also relates to a boiler furnace which utilizes injected air comprising: (a) a furnace chamber; (b) a first set of small and large openings located on one wall of the interior of the furnace; and (c) a second set of small and large openings located on the wall of the interior of the furnace opposite the first wall, the positions of the second set of openings being opposed in relation to the first set of openings so that a small opening in the first wall opposes a large opening in the opposite wall, and a large opening in the first wall opposes a small opening in the opposite wall of the furnace.

In the furnace, the first set of small and large openings can alternate with one another. The second set of small and large openings can also alternate with one another. The air may be injected into the interior of the furnace either horizontally or downwardly.

In the furnace, more openings of similar size can oppose fewer openings of similar size.

In the furnace, a third and fourth set of alternating small and large openings can be located at an elevation in the interior of the furnace, higher than the first and second set of openings. The first and second sets of openings can be on two opposing walls of the boiler furnace interior and the third and fourth set of openings can be on two opposing walls of the boiler furnace interior other than the walls in which the first and second set of openings are located.

The boiler can be a kraft recovery boiler or a wood-waste fired boiler.

DRAWINGS

In the drawings which illustrate specific embodiments of the invention but which should not be construed as restricting the spirit or scope of the invention in any way:

FIG. 1*a* illustrates a plan view of a conventional boiler furnace at the primary air level with jet interference arising from air injected below the liquor spray level from all four walls of the furnace, at a given elevation.

FIG. 1*b* illustrates a side view of the lower furnace of a conventional boiler with jet stream trajectories, that form a chimney flow pattern for the air introduced at the same elevation as in FIG. 1*a*, in this case with no secondary air, and tertiary air introduced tangentially above the liquor spray level.

FIG. 2*a* illustrates a plan view of a conventional boiler furnace with four-wall air introduction, below the liquor spray level.

FIG. 2*b* illustrates a side view of the lower furnace of a conventional boiler with air introduction from four walls at both the primary and secondary levels, below the liquor spray level, creating a chimney flow pattern with a central updraft, and with tertiary air introduced above the liquor spray level.

FIG. 3*a* illustrates air velocity measurements on a horizontal grid at the liquor spray level in 1/12th scale physical flow model of a traditional Combustion Engineering-type recovery boiler, having just one level of air below the liquor spray level, where the air is introduced from all four walls of the furnace.

FIG. 3*b* illustrates a graphical depiction of measurements of air velocity extremes distribution at the liquor spray level of a traditional Combustion-Engineering-type recovery boiler, where the primary air is introduced off all four walls of the furnace.

DETAILED DESCRIPTION OF A SPECIFIC EMBODIMENT OF THE INVENTION

Figure 1A:
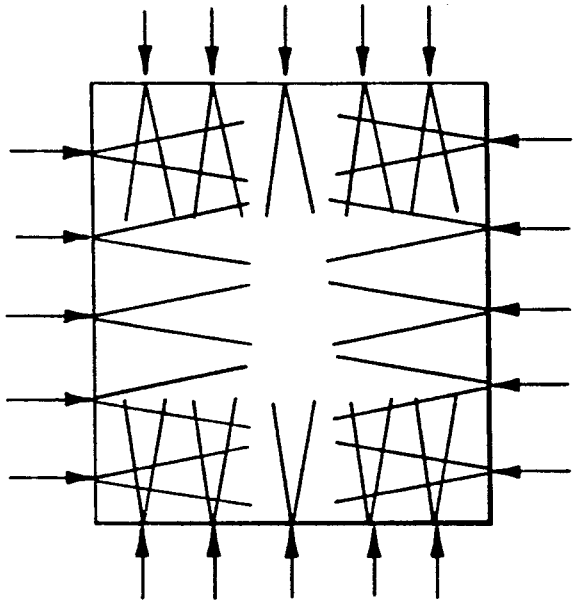
Figure 1B:
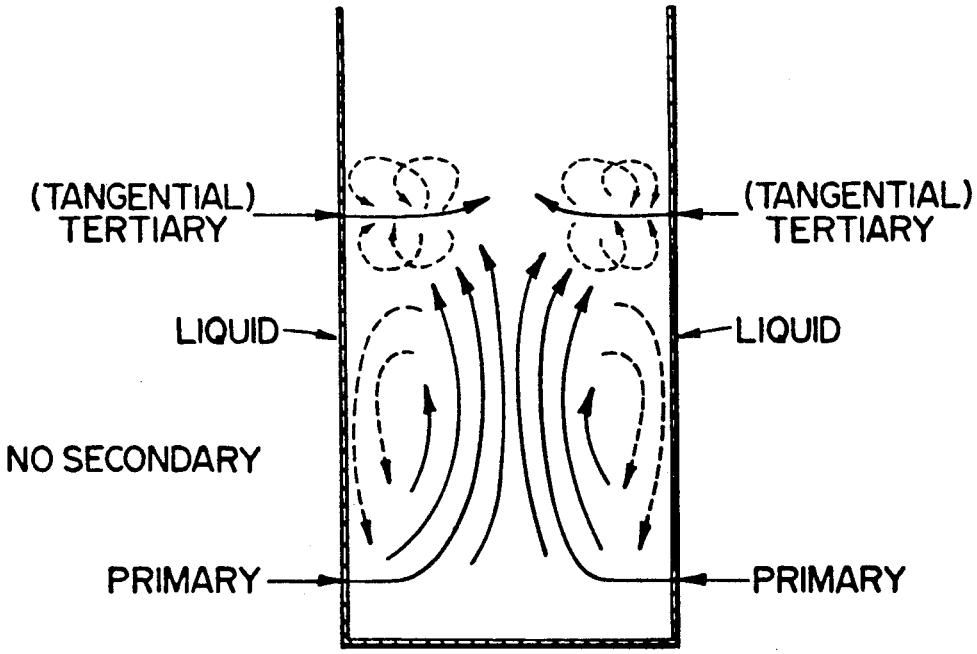
Figure 2A:
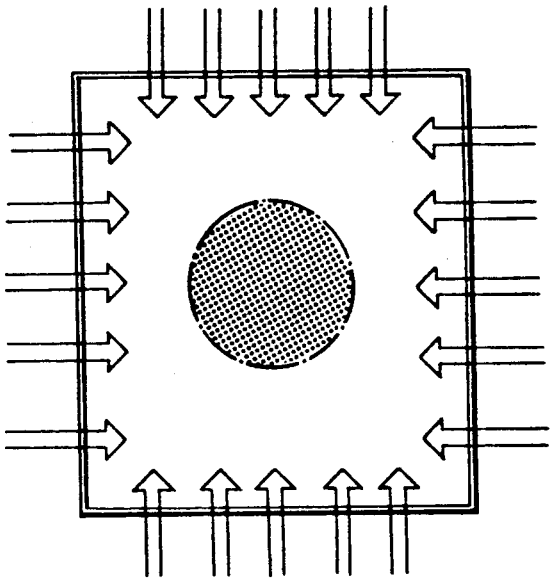
Figure 2B:
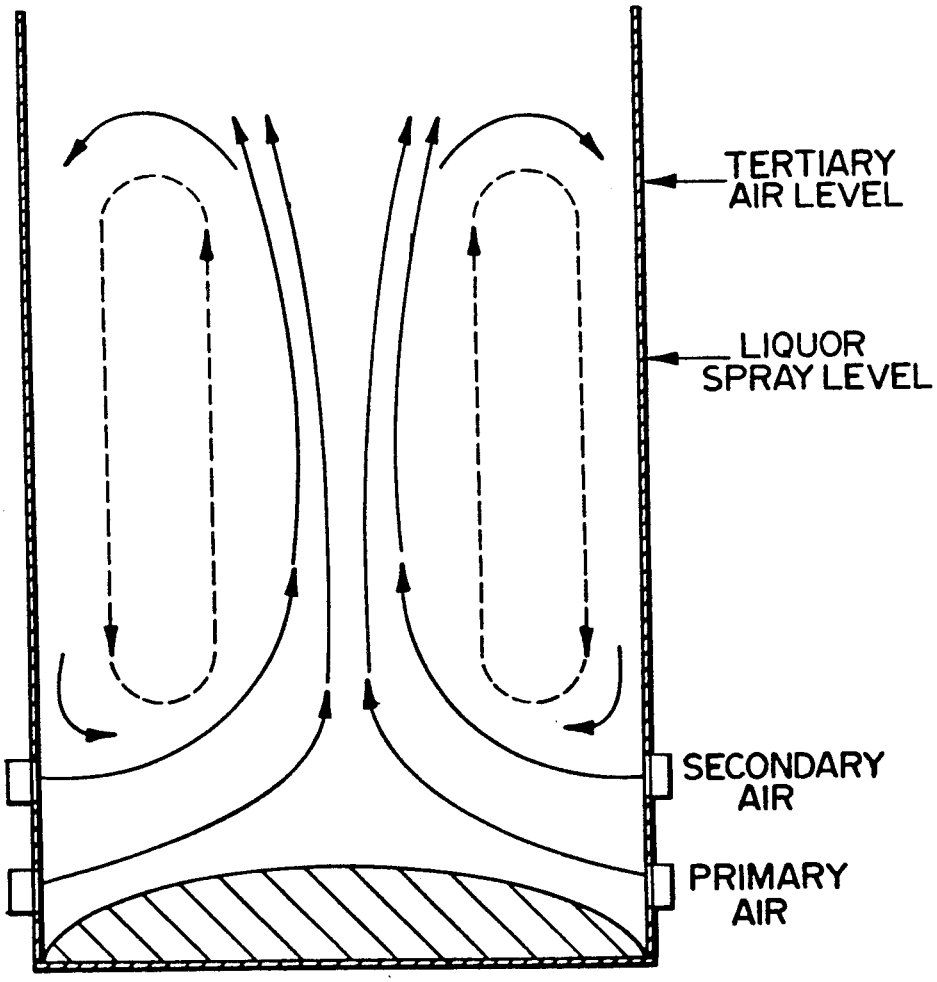
Figure 3A:
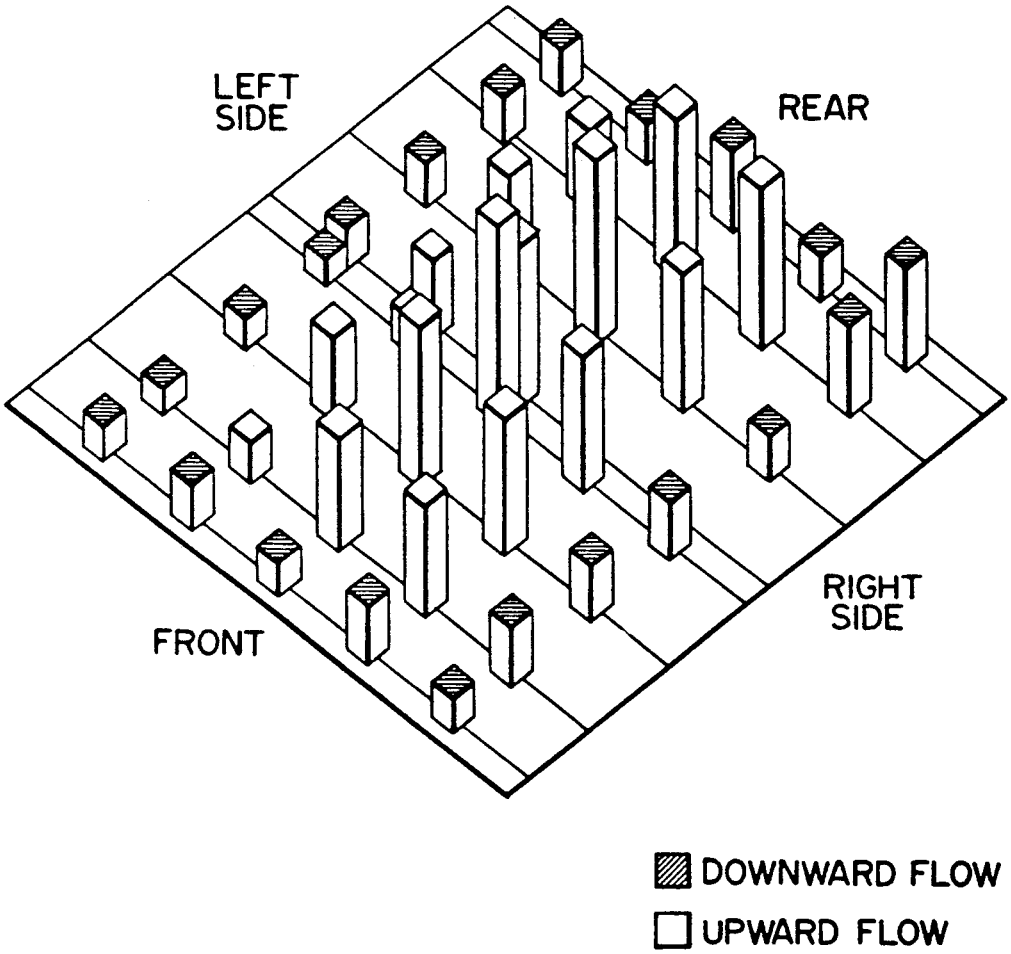
Figure 3B:
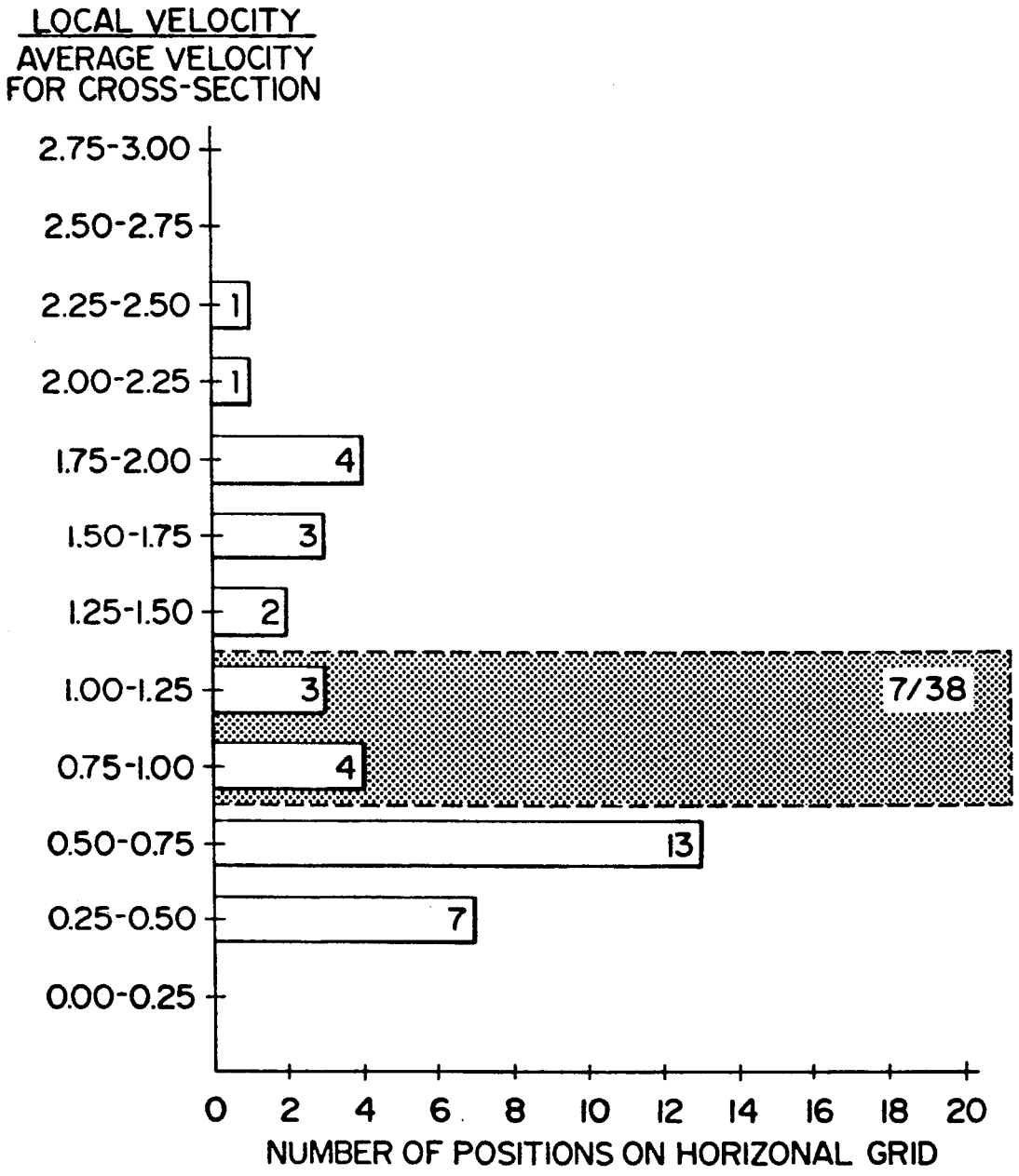

FIGS. 1a, 1b, 2a and 2b depict the detrimental recirculation and central core updraft circulation patterns that exist in conventional boilers. Supporting air velocity data obtained in a 1/12th scale physical flow model are shown in FIGS. 3a and 3b. For the data in FIGS. 3a and 3b, the model was operated with two air levels: primary air, equivalent to about 75% of the total air flow, coming equally from all four walls; and 25% of the total air introduced tangentially above the liquor spray level. A similar velocity profile was measured at the liquor spray level in the actual recovery boiler itself during special cold flow testing.

The inventors have taken two approaches to reduce gas velocity extremes and thereby reduce gas entrainment of liquor spray particles.

First, the air is introduced in such a manner as to create a gross gas flow pattern in the furnace that avoids or minimizes the adverse central updraft core and any recirculation pattern. In the ideal case, the upflowing gases should be evenly distributed across the entire furnace horizontal cross-sectional area and the recirculation of gases from an upper region of the furnace to the bottom should be eliminated. In other words, plug flow upwards is the ideal case.

Secondly, the secondary air is introduced into the furnace through as much port area as practically possible. This minimizes the velocities in the jets themselves while maintaining adequate jet stream momentum for good penetration. In this disclosure, the terms jet and jet stream are used interchangeably and refer to the stream of gas that is emitted from the furnace wall through a specific opening (a port) or group of openings.

The inventors have invented several ways to minimize velocity extremes in the bulk upflow of gases in the furnace.

Fully Opposed Primary Jets, on Two Opposite Walls

Figure 4:
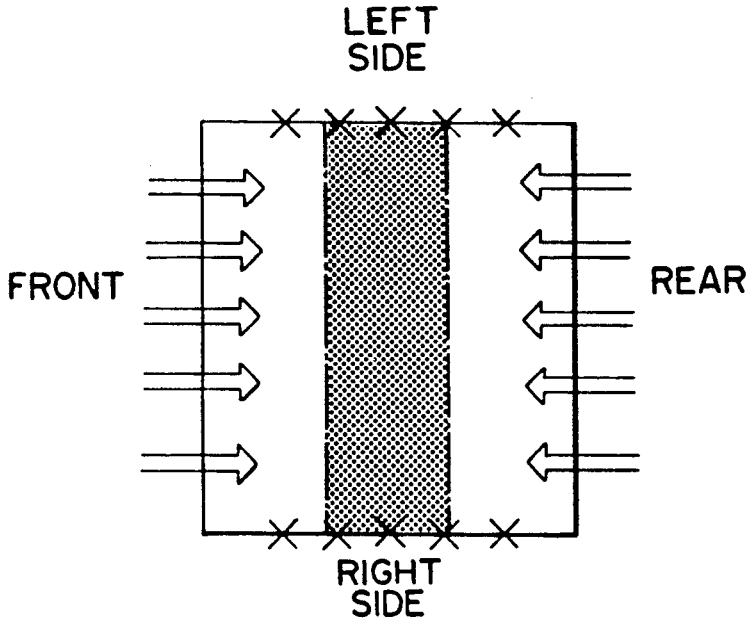
FIG. 4 illustrates a plan view of a somewhat improved situation involving an enlarged central updraft core in the lower furnace of a boiler, created by air introduction from two opposite walls, using fully (equally) opposed jets.

A first level of improvement toward the ideal situation, that relates to boilers with only one level of air in the lower furnace, below the liquor gun level, particularly existing boilers of this design, can be achieved by using air ports on two opposite furnace walls only, preferably the front and rear walls. A system along these lines is illustrated in FIG. 4. This is referred to herein as Fully Opposed Primary Jets on Two Opposite Walls. In this way, air is not introduced at right angles from the other two walls, at a given furnace elevation, and does not interfere with these first jets. Typically, in this invention, primary air is introduced on the front and rear walls only, with no primary air being introduced from the side walls. While this arrangement still produces a central updraft core, and a recirculating gas pattern with downflow adjacent to the front and rear walls, the area of the central updraft core is enlarged to occupy about ⅓ of the cross-sectional area instead of the normal 1/9 common with conventional four-wall primary operation. This increase in the area of the updraft core reduces the upward gas velocities in the central area of the furnace because more area is available for gas updraft.

In existing boilers having primary air ports on all four walls, the approach can be implemented simply by closing the dampers in the registers ahead of the ports on two opposite walls, preferably on the side walls. This approach has the additional advantage that the air velocity from existing primary ports in the front and rear walls of the furnace must approximately double, thereby improving char bed control. Better char bed control allows the liquor spray temperature and/or pressure to be decreased, so that the liquor spray has generally larger particles. With generally larger spray particles, fewer of the finer particles are entrained. Granted, with the increased velocity of the primary jets, there is an increased tendency to scour particles off the char bed. However, recovery boiler experience discussed earlier indicated that particles scoured off the char bed are not the dominant source of material for fireside deposits; fine liquor spray particles are the dominant source. Entrainment of fine liquor spray particles is decreased by both the lower liquor spray temperature allowed by better char bed control, and by the reduced upward velocities in the central updraft core provided by the enlarged cross-sectional area of the central updraft core. The observed net result is an overall decrease in the entrainment of liquor spray particles.

The first approach can be implemented partially, by injecting a greater amount of the primary air through one set of two opposing walls, for example, the front and rear walls, and injecting a lesser amount through the other set of opposing walls, for example, the left and right side walls.

On a boiler with two levels of air in the lower furnace below the liquor spray, this first approach would be best implemented by restricting the secondary air in the same way as the primary air; for instance, if all of the primary air, or most of it, comes from the front and rear walls, then all the secondary air, or most of it, should come from the front and rear walls.

The concept of fully opposed primary jets, on two opposite walls, has been tested on three operating boilers: a five-week trial on one boiler and a two-day trial on two other boilers. All three boilers had only one level of air below the liquor spray level. Monitoring was not rigorous, so the observations are limited to general impression. The char bed was flatter and easier to control, allowing an approximate 1° F. decrease in liquor spray temperature (not insignificant) for the same char bed size. Observation of sparklers at the furnace exit indicated a decrease in the carryover of liquor spray particles. The image on the char bed TV camera was brighter, especially in the centre of the bed, indicating higher temperatures. This suggests better mixing of the combustion air and combustible gases in the lower furnaces. No operational problems of concern were observed.

Full Interlacing (Unopposed Jets)

Figure 5A:
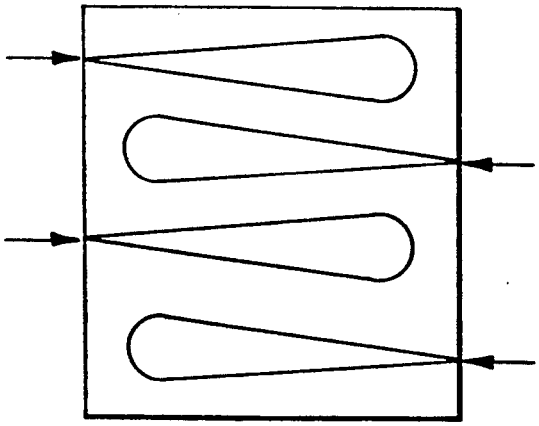
FIG. 5a illustrates a plan view of the jet stream pattern in a boiler furnace created by fully interlacing (unopposed) jet streams originating from opposing walls.
Figure 5B:
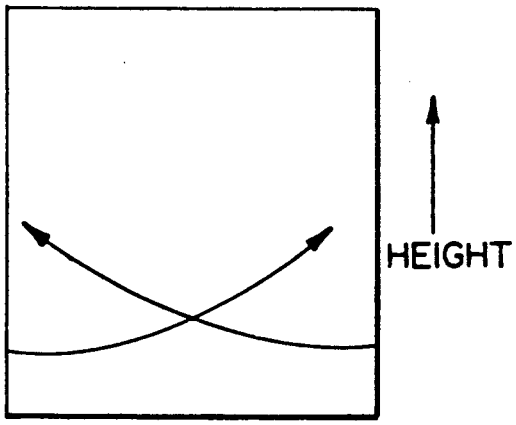
FIG. 5b illustrates a side view of the jet stream pattern in a boiler furnace created by fully interlaced (unopposed) jet streams.

Some level of improvement can be obtained relative to conventional practice by utilizing a jet interlacing pattern. Such a pattern is depicted in FIGS. 5*a* and 5*b*. In this arrangement, the ports are located on two opposing walls of the furnace, but the ports on the two opposing walls are offset so that the opposing jet streams interlace fully without direct opposition and do not interfere with each other head-on. Wilcoxson, U.S. Pat. No. 2,416,462, discloses a concept involving interlacing at the tertiary air level of the furnace, above the liquor spray level. Wilcoxson did not optimize the pattern at the tertiary level and did not apply it to the primary and secondary levels of the furnace below the liquor spray. Fridley and Barsin, referred to earlier, disclose full interlacing at the tertiary level as well as the secondary level, below the liquor spray level, but not at the primary level.

To avoid impingement of high oxygen-content gases on the furnace walls, there should be a minimum distance between the closest air jets and furnace wall parallel with, and adjacent to the outermost jets at a given elevation, say between the side wall and the nearest ports in the front and rear walls of the furnace. The minimum distance from the side wall should be determined by the spread pattern of the jet stream, and the decay of the centreline oxygen concentration. The size, velocity, and orientation of each jet should be such that impingement on the opposing wall by gas having a high oxygen concentration is avoided. Furthermore, if large ports are used, each port should have a damper.

Figure 6A:
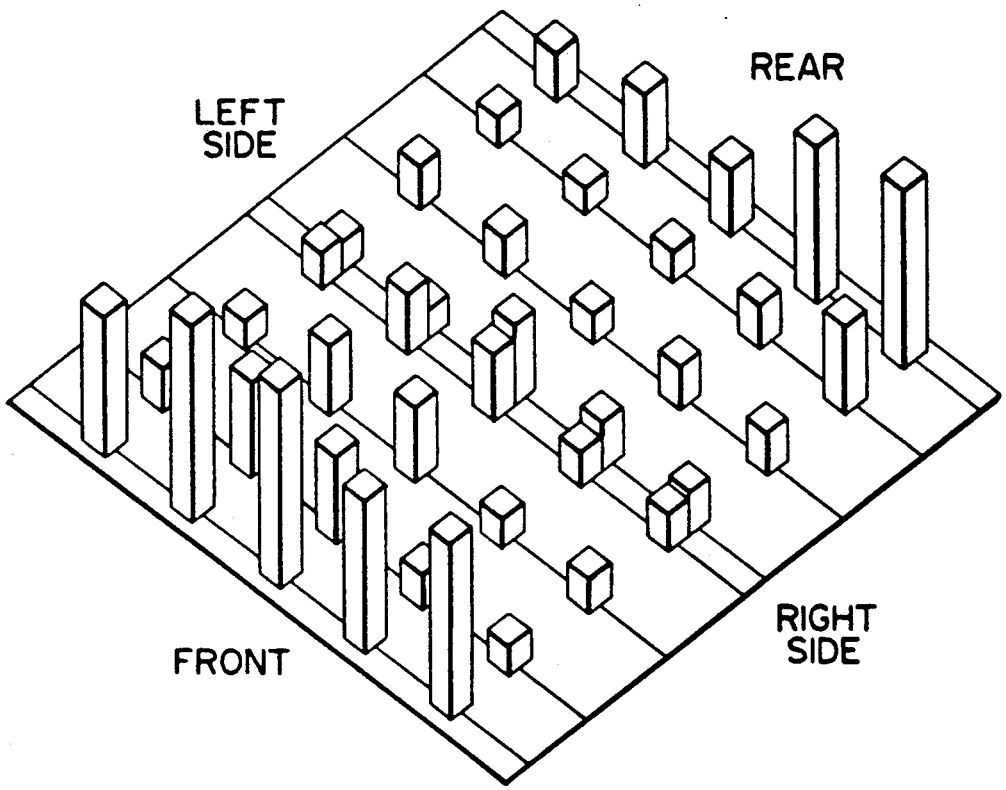
FIG. 6a illustrates air velocity measurements on a horizontal grid at the liquor spray level in the physical flow model, with an added second level of air below the liquor spray level, operated with jets originating from the front and rear walls in fully interlaced (unopposed) fashion.
Figure 6B:
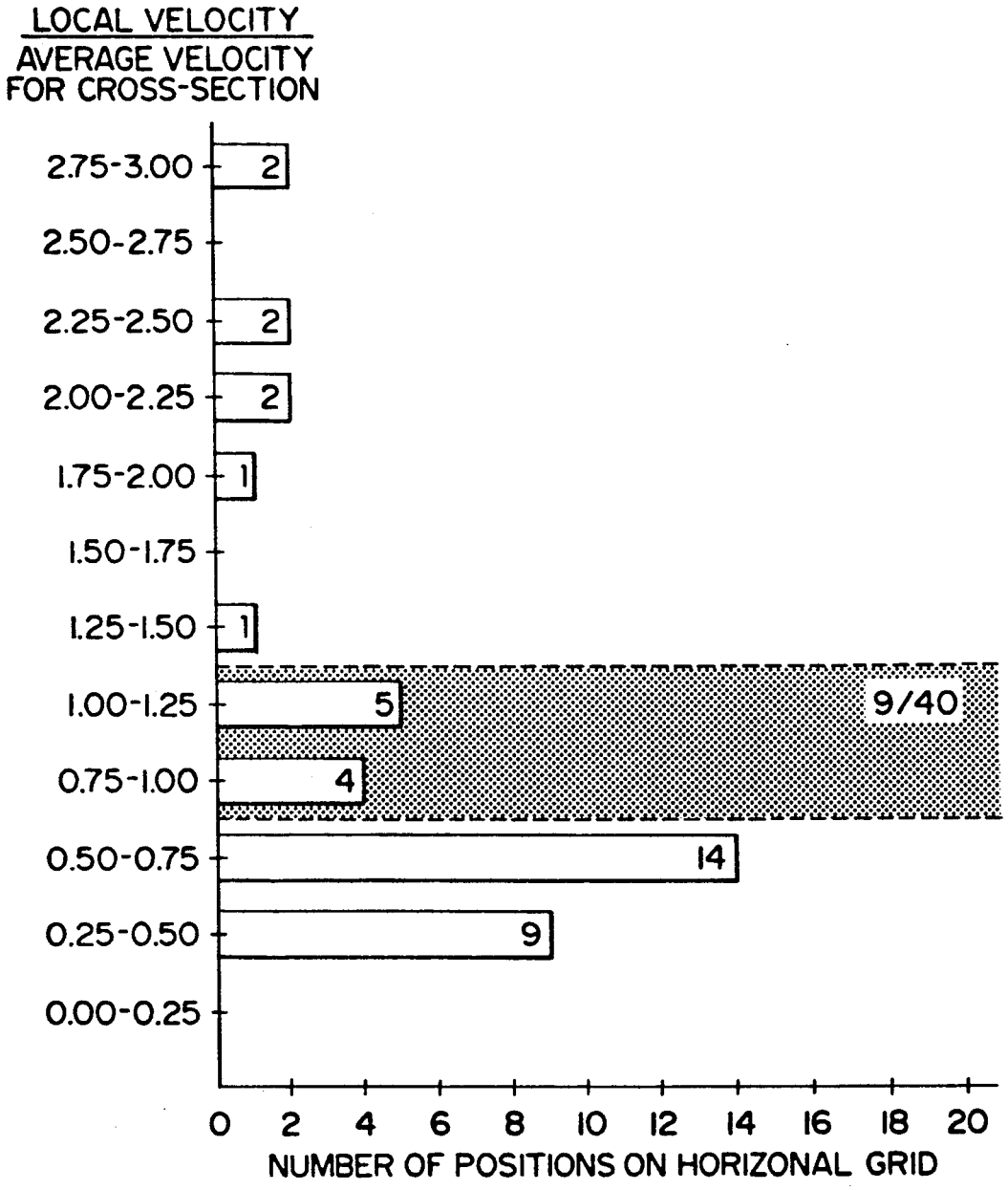
FIG. 6b illustrates a graphical depiction of measurements of air velocity extremes distribution at the liquor spray level, with an added second level of air below the liquor spray level, operated with jets originating from the front and rear walls, in fully interlaced (unopposed) fashion.

FIGS. 6*a* and 6*b* summarize the air velocity profile measured in a 1/12 scale physical flow model at the liquor spray level with an added second level of air below the liquor spray level operating with unopposed secondary jets from the front and rear walls in a fully interlaced fashion. Comparison of FIGS. 3*a* and 3*b* with 6*a* and 6*b* indicates that the chimney flow pattern of the traditional approach was broken, but there is little improvement in the uniformity of the velocities on the furnace horizontal cross-sectional area at the liquor spray level because, with the fully interlaced arrangement, there were high upwards velocities beside the front and rear walls. It was determined that the unopposed jets were sweeping up the opposite walls. The same general pattern results with unopposed fully interlacing jets originating from the two side walls only.

Operation with fully interlaced jets has the disadvantage that the ports need to be properly designed and operated carefully to minimize the impact of having the jets sweeping up the opposite walls with high velocities.

Partial Interlacing (Unequally Opposed Jets)

The inventors believe that a key to improving the manner and efficiency in which the combustion air is injected into the furnace is to minimize interference between the jets, while avoiding high velocities adjacent to the furnace walls and avoiding consequent impingement of high oxygen-content gas on the furnace walls. The interference of the jet streams with the liquor spray is also of some concern. Local velocity extremes can be reduced by using low initial jet velocities by using air ports as large as possible. By avoiding interference between the air jet streams themselves, detrimental entrainment of liquor spray particles is further reduced.

While full air jet stream interlacing, using unopposed jets, provides an improvement over completely opposed jets in reducing jet interference, it is clear that complete jet stream interlacing has the disadvantage that it reduces the number of sites for air inlet ports on a given furnace wall at a given elevation. Thus, to enable the required quantity of air to be injected into the furnace at a given air level, either larger ports, or higher air velocities from the ports are necessary. For the air introduced above the liquor sprayers, where the quantity of introduced air is not large, reduction in the number of entry sites is not a problem and complete interlacing is acceptable at that level.

Figure 7:
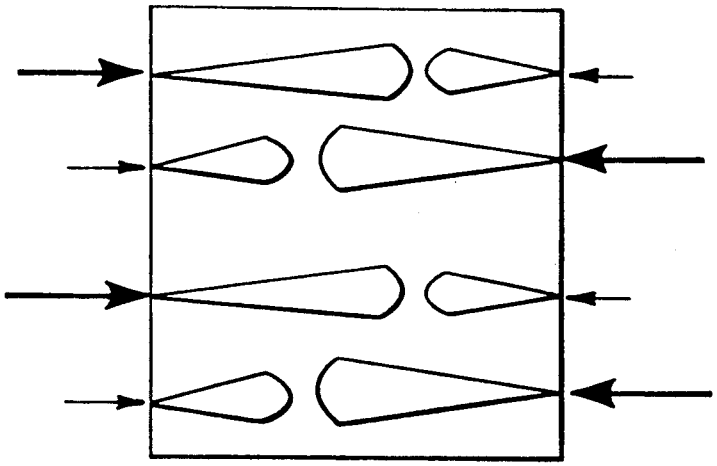
FIG. 7 illustrates a plan view of the jet steam pattern in a boiler furnace with partially interlacing jet streams (unequally opposed jets) originating from opposing furnace walls.

At air entry locations below the liquor gun level, however, the necessary large size of the ports and/or high port discharge velocities becomes a problem, especially since the streams from big ports tend to sweep up the opposite walls of the furnace with high velocity. The inventors have overcome this problem by inventing a partial interlacing pattern, using unequally opposed jets (i.e. opposed jets of unequal size), as illustrated in FIG. 7. With this pattern, a larger jet originating from one furnace wall is opposed in an alternating fashion by a smaller jet originating from the opposite furnace wall. This pattern allows more total port area at a given air level and inhibits the jet streams from large ports from sweeping the opposite furnace wall. Where the stream from the bigger jet meets the stream from the smaller jet, they rise forming a small updraft. However, each updraft is a localized updraft without a significant re-circulation pattern. Further, the updraft created by the collision of the small and large jets from opposing walls is closer to the wall from which the smaller jet is issuing. Considering the proposed pattern of alternating small and large jets issuing from each wall, a series of small updrafts is created. Relative to each wall, these small updrafts are alternately close to the source of each small jet, then distant from the source of each large jet, across the width of the wall. In plan view, the partially interlaced jets create a staggered pattern of small updrafts rather than a large detrimental central updraft with an inherent and significant re-circulation pattern.

A large jet, partially opposed by a smaller jet, can be created in several ways:

1. Use of a larger port, opposite a smaller port, with the same air pressure behind each port.

2. Use of a group of adjacent larger ports, opposite a group of a similar number of adjacent smaller ports, with the same air pressure behind all ports.

3. Use of a group of ports of the same size with the same air pressure behind the ports, the larger jet being formed with a group of a larger number of ports than the smaller jet. For example, there could be two adjacent ports opposite a single port, or three adjacent ports opposite two adjacent ports, etc.

4. Use of two opposing ports of the same size, but creating a higher pressure behind one of the ports to obtain more flow and hence a larger jet than from the opposing port.

5. Use of two groups of opposing ports, with about the same number of ports in each group, and all the ports about the same size, but creating a higher pressure behind one of the groups of ports to obtain more flow and hence a larger jet than from the opposing group of ports.

Basically, a large jet partially opposed by a small jet, can be created by either a greater total port area on one wall, opposite a smaller total port area on the opposite wall, all ports having the same air pressure behind them, or similar total port area on the opposing walls, with a higher pressure behind the ports on the one wall compared to the opposing wall.

A physical flow model (1/12 scale) of a traditional Combustion Engineering-type recovery boiler was constructed and operated to test the inventors' theories. The model was operated with both water and air as the working fluid. With water as the working fluid, polystyrene pellets were introduced into the jet streams to enable the jet stream patterns to be seen and to provide qualitative impressions. With air as the working fluid, quantitative measurements were made.

Figure 8A:
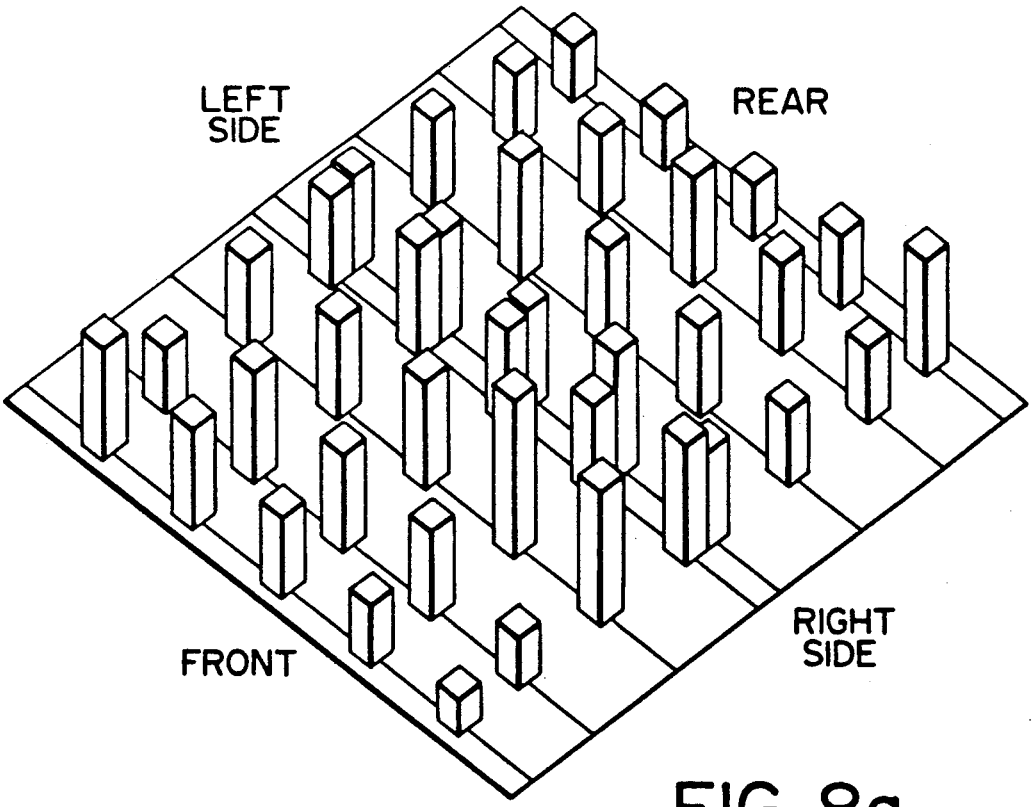
FIG. 8a illustrates air velocity measurements on a horizontal grid at the liquor spray level in the physical flow model, with an added level of secondary air below the liquor spray, operated with jets originating from the front and rear walls in a partially interlaced fashion, using unequally opposed jets.
Figure 8B:
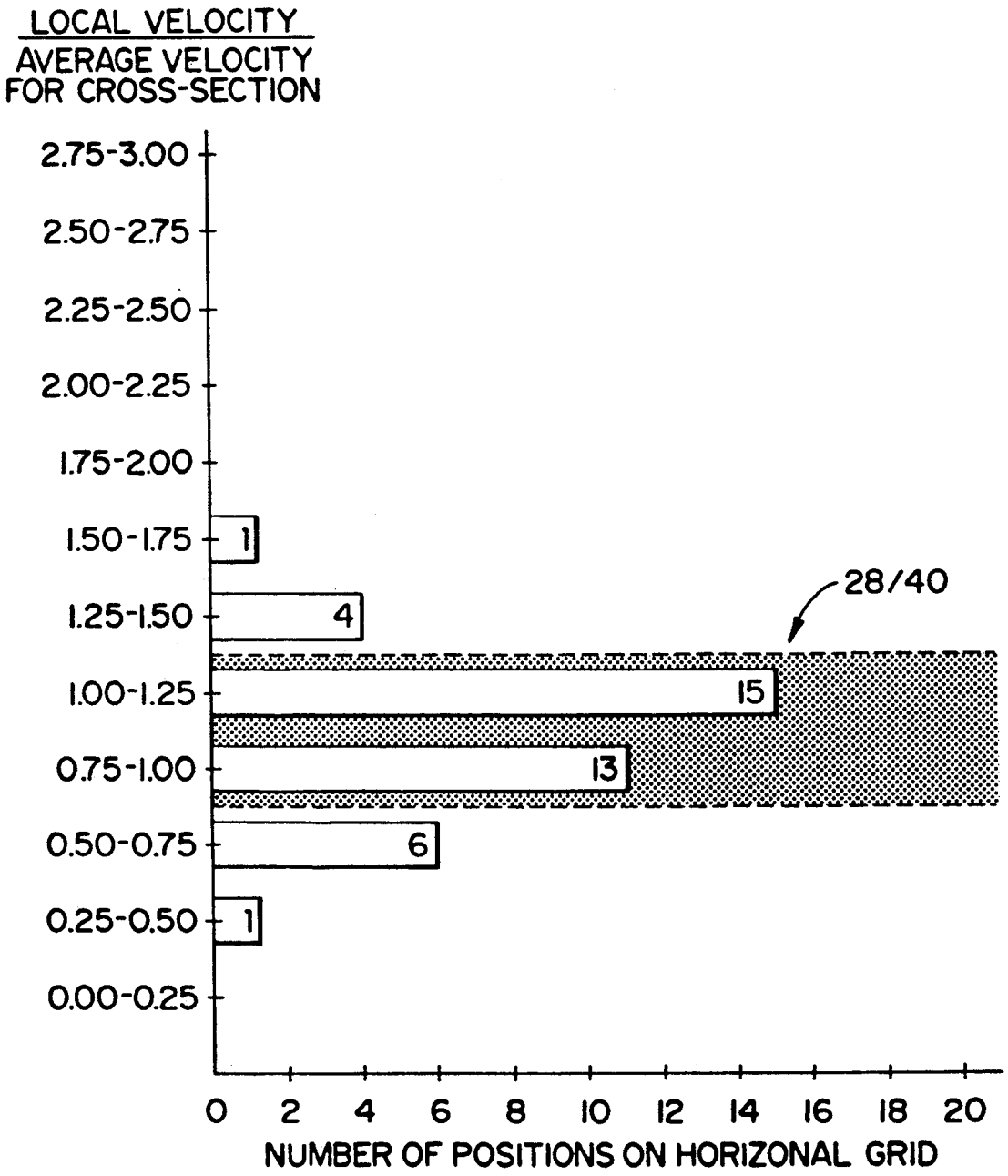
FIG. 8b illustrates a graphical depiction of measurements of air velocity extremes distribution at the liquor spray level with an added level of secondary air below the liquor spray, operated with jets originating from the front and rear walls in a partially interlaced fashion, using unequally opposed jets.

FIGS. 8*a* and 8*b* summarize the air velocity profile measured in the physical model at the liquor spray level with an added second level of the air below the liquor spray level, operating with unequally opposed secondary jets originating from the front and rear walls in a partially interlaced fashion. Comparison of FIGS. 8*a* and 8*b* with FIGS. 3*a* and 3*b* indicates that the chimney flow pattern of the traditional approach was broken and there was a substantial improvement in the uniformity of the velocity profile with partial interlacing. Except for one high reading near the right side close to the front, the velocity profile with partial interlacing is almost flat. Comparison of FIGS. 8*a* and 8*b* with FIGS. 6*a* and 6*b* indicates that partial interlacing is superior to full interlacing in providing a uniform velocity profile at the liquor spray level.

With the full interlacing jet pattern shown in FIG. 5 and the partial interlacing jet pattern in FIG. 7, there is no disadvantageous main central updraft core. Likewise, there is no detrimental recirculating pattern, as is the case with the arrangements depicted in FIGS. 1 and 3. In particular, partial interlacing reduces velocity extremes in the furnace horizontal cross-section area in the lower furnace below the liquor spray level, relative to the conventional arrangements depicted in FIGS. 1 and 3, and relative to the full interlacing arrangement in FIG. 5.

Figure 9A:
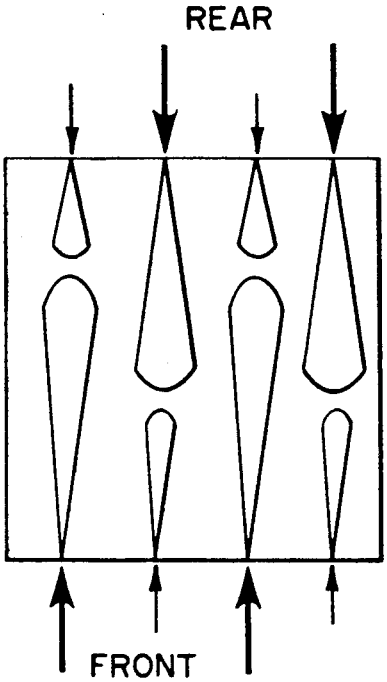
FIG. 9 illustrates two plan views of the jet stream patterns in a boiler furnace with partially interlaced jet streams at a lower air level originating from one pair of opposing walls and an adjacent upper air level originating from the other pair of opposing walls.
Figure 9B:
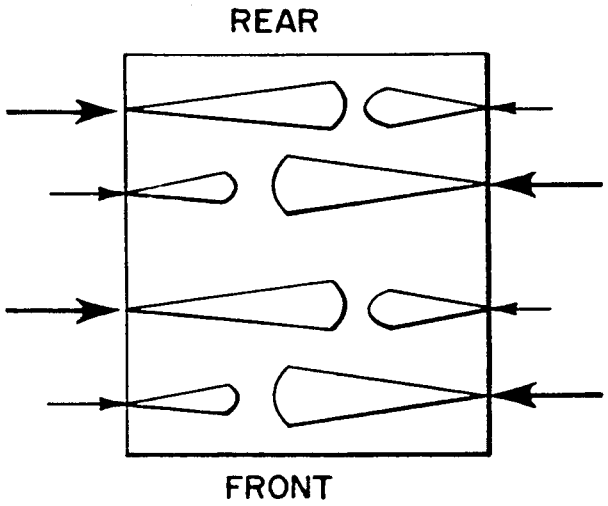

It is evident that with the partial interlacing or total interlacing concept of the invention, using only two opposite walls (rather than all four walls) the amount of air that can be introduced into the furnace at a given air level is limited, particularly if the port discharge velocity is to be kept low. The inventors have determined that this potential handicap can be overcome by utilizing several air levels, for example, two, three or four, below the liquor spray level, and another air level above the liquor sprayers. With these different air levels, it is preferable that the opposing furnace walls used for introduction of air at each level are alternated as shown in FIG. 9. As shown, the jets on one elevation are positioned, for example, on the front and rear walls of the furnace while the jets on the next adjacent elevation are positioned on the respective side walls of the furnace, and so on, for as many levels as are used. Furthermore, interference between two air levels relatively close together vertically can be reduced by orienting the ports in the lower level, downwardly or horizontally, while having the upper level oriented horizontally or slightly upwards. The final jet orientation arrangement is selected to provide as equal gas temperatures as possible across the horizontal cross-section of the furnace of the boiler. This objective is aided by placing the uppermost layer of ports above the liquor spray level, in the front and rear walls of the furnace, rather than in the side walls.

Fridley and Barsin, referred to earlier, disclose alternating the opposing furnace walls used for introducing secondary air and tertiary air, in a boiler having three air levels, two levels below the liquor spray level and a third level above the liquor spray level. At both the secondary and tertiary levels, they applied a fully interlaced pattern using unopposed air jets, using the front wall and rear wall at the secondary level, and the two side walls at the tertiary level. Their disclosure is limited to fully interlaced unopposed jets.

With total interlacing air jets as shown in FIG. 5, or partial interlacing as shown in FIG. 7, it is important that no air is introduced at right angles to the interlacing pattern at that elevation. If air is introduced from ports in a third wall, or a third and fourth wall at the same elevation, then there is a tendency to form an adverse central updraft core.

The shape of the port is also an important contributing factor to promoting efficiency. Rectangular ports are known to mix the air into the furnace surroundings more quickly than do circular or square ports. For large ports, such as at the primary and secondary levels below the liquor spray level, where there is a large amount of air to be introduced at the same air level, rectangular ports are preferred. However, for the tertiary air level, where a large region of the furnace is to be covered by a small quantity of air coming from a few ports, circular or square ports are preferred. These carry the oxygen in the air jet a greater distance before mixing and combusting.

The jets should preferably be introduced at several elevations in the furnace, using one of the two following methods at a given elevation:

1. A relatively small number of large ports, located in two opposing furnace walls, preferably with the jets partially interlacing (or, less preferably, completely interlacing as is the pattern of the air introduced above the liquor spray level).

Figure 10:
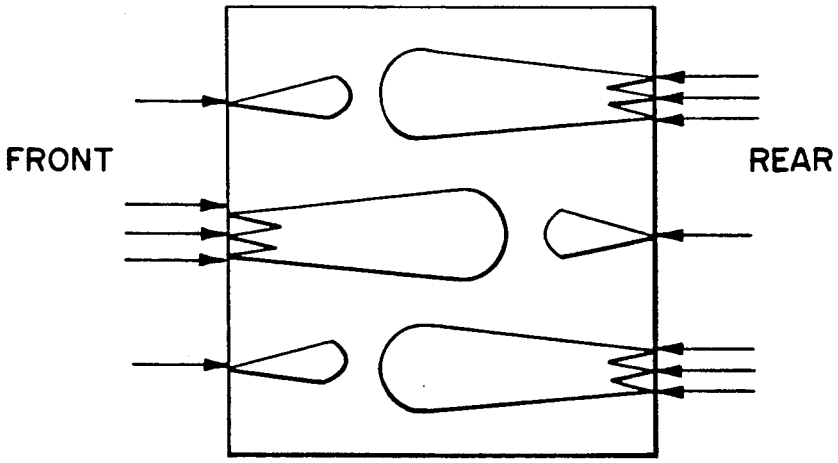
FIG. 10 illustrates a plan view of the jet stream pattern in a boiler furnace with partially interlacing jet streams, based on a register effect, in which several adjacent small jets combine to form a single larger jet.
Figure 11A:
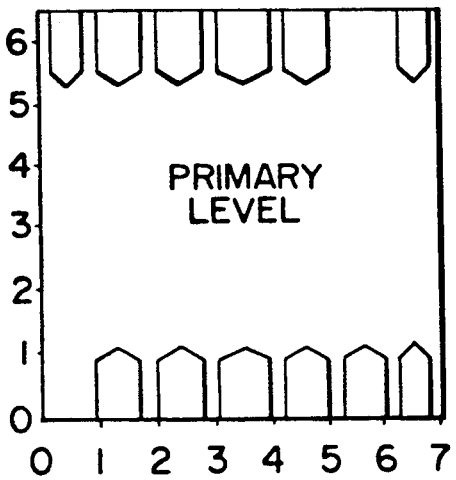
FIG. 11 illustrates the air port layout utilizing partially and totally interlacing jet streams in one recovery boiler by showing four plan section views of three elevations in the furnace.
Figure 11B:
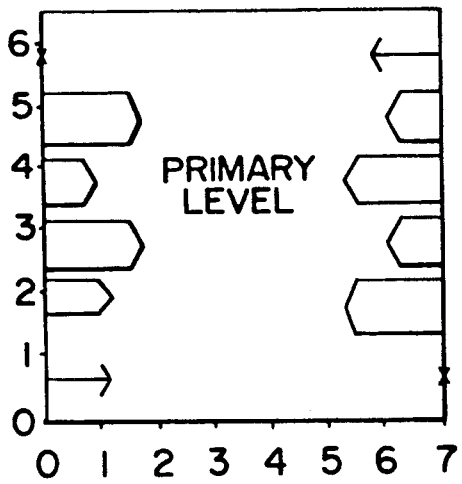
Figure 11C:
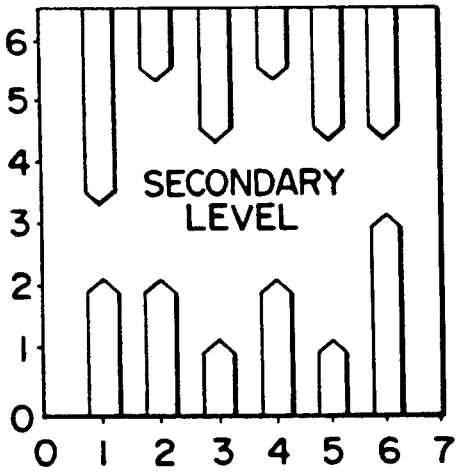
Figure 11D:
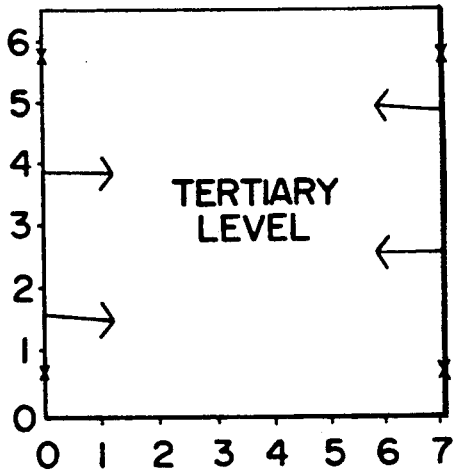

2. A large number of smaller ports, rectangular in shape, arranged in groups forming a register effect so that the jets in one group merge together a short distance from the wall to form one larger jet, as shown in FIG. 10. These groups would be located on two opposing furnace walls, with the large compound jets completely or partially interlacing.

It is evident that the problem with gas velocity extremes and detrimental central updraft in recovery boilers as presently constructed, originates at the primary air level and becomes accentuated at each successive higher air entry level. To address these problems utilizing the design concepts of the invention, two basic approaches can be taken.

One approach is to completely eliminate or minimize the source of the problem. This approach involves using the jet stream patterns illustrated in FIGS. 5, 7, 9 and/or 10 at all air levels, especially the primary level. This approach is expensive, however, and is applicable mainly to the construction of new boilers.

A second, less costly, approach involves minimizing modifications at the primary air level. With this approach, an updraft is permitted to develop at the primary level but the updraft is then corrected or minimized at the secondary and tertiary air levels. First, the updraft created at the primary level can be enlarged and the velocity extremes reduced, as noted above, by admitting the air from two opposed walls only, by closing the primary parts on the other two walls. Then the design patterns shown in FIGS. 5, 7, 9 and/or 10 are applied at the secondary level. In a sense, this corrective approach can be regarded as putting a blanket over the upflowing gases, and in so doing, evening out the gas flow to minimize the velocity extremes. The first approach is preferred if expense is not a problem, or circumstances permit, although some success can be achieved with the second approach. As a general rule, the first approach should produce more satisfactory and more extensive results.

A number of considerations should be taken into account in applying the design concepts and patterns of the partial interlacing (unequally opposed jets) invention to each elevation in the boiler.

A: Primary Air Level (Immediately above the char bed): Ideally, the primary air level should be modified according to the partial interlacing concepts shown in FIGS. 7, 9 and 10. However, in existing boiler retrofit situations, it may be desirable to restrict the modifications and use as many of the existing ports as possible to minimize capital costs and to minimize port discharge velocities. In such retrofit situations, the partial interlacing concept involving the register effect, illustrated in FIG. 10, should be particularly suitable. When attempting to use most of the existing ports in a retrofit situation, it may not be possible to inject the required amount of air into the boiler if only two opposing walls are used for ports. Where this is the case, and ports are required on all four walls, jet interference can be minimized by the elevation and orientation of the ports. For one set of opposing furnace walls (e.g., the front and rear walls), the jets should be pointed downwards; for the other set of opposing furnace walls (e.g., the two side walls), the jets should be raised in elevation somewhat and/or pointed closer to horizontal.

B. Secondary Air Level (Approximately one metre above the primary air level): The partial interlacing arrangement shown in FIGS. 7, 9 and 10 is particularly useful for the secondary air level. This arrangement can be used in both new and retrofit situations.

C. Liquor Spray Level (Above the primary and secondary air levels): Air that infiltrates into the ports for the liquor gun nozzles enters the boiler with low velocity because of the low difference in pressure between the outside and the inside of the furnace. The streams from these guns therefore have little momentum and are readily deflected upwards. Because of this fact, the size of the liquor gun ports should be minimized. A removable device can be used to blank off the open area around the gun.

D. Tertiary Air Level (Above the liquor guns): In conventional boilers with two full levels of air entry below the liquor spray level and one level of air above the liquor spray level, five to twenty percent of the total combustion air is introduced into the furnace at the tertiary level, some distance above the liquor guns. The total combustion air quantity that is introduced into the boiler is, however, only 105 to 110 percent of the stoichiometric air quantity. Therefore, the combustion cannot be completed until the tertiary air is added. The basic thrust of the proposed system of the invention is contrary, namely to complete the combustion at as low an elevation in the furnace as possible. In boiler operation, there is some volatilization of hydrogen sulphide and organic combustibles, such as terpenes, from the liquor spray while the liquor spray travels across and down into the furnace. For efficient operation, these combustibles must be burned. Also, furnace gases coming from below the liquor gun level contain some combustibles such as CO and $H_2S$. There can also be some oxygen in the furnace gases coming from below the liquor gun level because mixing may not be ideal at lower elevations in the furnace. If all of the combustion air ultimately required in the efficient operation of the boiler has been added below the liquor guns, then additional mixing, rather than more air, is all that is required at the tertiary level. Jets are effective as mixing devices, so the requisite additional mixing can be provided by the introduction of any suitable fluid such as air, steam or clean flue gas (for example, from the outlet of the precipitator of the system) through suitably designed ports at the tertiary level. Where energy efficiency is important, re-cycled flue gas is the best option. Where either increased capacity or decreased odorous emissions are the most important, unheated ambient air is the best option. The design concepts illustrated in FIG. 5, depicting complete interlacing with unopposed jets, can be used at the tertiary level. The mixing and penetration of these jets can be improved by angling them downwardly (e.g. 30°) into the upflowing gases. Also, pointing the jets downwardly delivers the air to a lower effective elevation in the furnace, thereby helping to complete the combustion at as low an elevation in the furnace as possible. However, when directing the tertiary jets downwards, care must be taken that they do not interfere with the liquor spray.

PROTOTYPE DESIGN

FIG. 11 illustrates, in composite, three elevations in an actual boiler employing the patterns and design concepts discussed above in relation to FIGS. 7, 9 and 10.

Jet locations and relative air jet stream flows are depicted by means of pointed block arrows at the primary and secondary levels and pointed arrows at the tertiary level. For clarity, the primary level is broken into two depictions.

As will be apparent to those skilled in the art, in the light of the foregoing disclosure, many alterations and modifications are possible in the practice of this invention without departing from the spirit or scope thereof. Accordingly, the scope of the invention is to be construed in accordance with the substance defined by the following claims.

We claim:

1. A method for introducing primary air at the lowest airflow elevation into a boiler furnace having four walls, said method comprising:

(a) introducing air through at least one first jet located at a given elevation on a first wall of the interior of the boiler furnace;

(b) introducing air substantially at said given elevation through at least one second jet located on a second wall of the interior of the boiler furnace opposed to the first wall;

(c) introducing substantially no air at substantially said given elevation through the remaining walls; wherein (d) said first and second jets are arranged in opposed pairs with each pair including a large jet and a small jet.

2. The method according to claim 1 wherein said first jets comprise a single large port and said second jets comprise a single small port that is opposed to said large port.

3. The method according to claim 1 wherein said first and second jets comprise single similarly sized ports and high pressure air is introduced into one of said ports and low pressure air is introduced into the other of said ports.

4. A method according to claim 1 wherein a large jet opposes a small jet and a small jet opposes a large jet in each pair.

5. The method according to claim 1 wherein:

(a) said first jets comprise a first set of small and large ports;

(b) said second jets comprise a second set of small and large ports; and (c) the positions of the ports in said first and second sets are arranged so that each small port opposes a large port and each large port opposes a small port.

6. The method according to claim 5 wherein the small and large ports in said first set alternate with one another.

7. The method according to claim 6 wherein the small and large ports in said second set alternate with one another.

8. The method according to claim 1 wherein said first and second jets comprise opposed sets of similarly sized ports and high pressure air is introduced into one port in each pair of ports in said sets and low pressure air is introduced into the opposed port in such pair.

9. The method according to claim 8 wherein each set has ports having high pressure air introduced therein alternating with ports in the same set having low pressure air introduced therein.

10. The method according to claim 5 or 8 wherein the ports in said first set are pointed downwardly, horizontally, or slightly upwardly, and the ports in said second set are pointed downwardly, horizontally, or slightly upwardly into the interior of the boiler furnace.

11. The method according to claim 1 wherein third and fourth pairs of opposed small and large jets are located at substantially common elevations in the boiler furnace higher than said first and second jets.

12. The method according to claim 11 wherein said third jets comprise a single large port and said fourth jets comprise a single small port that is opposed to said large port.

13. The method according to claim 11 wherein said third and fourth jets comprise single similarly sized ports and high pressure air is introduced into one of said ports and low pressure air is introduced into the other of said ports.

14. The method according to claim 11 wherein the third and fourth jets comprise opposed sets of similarly sized ports and high pressure air is introduced into one port in each pair of ports in said sets and low pressure air is introduced into the opposed port in such pair.

15. The method according to claim 14 wherein each set has ports having high pressure air introduced therein alternating with ports in the same set having low pressure air introduced therein.

16. The method according to claim 11 wherein:

(a) said third jets comprise a third set of small and large ports;

(b) said fourth jets comprise a fourth set of small and large ports; and (c) the positions of the ports in said third and fourth sets are arranged so that each small port opposes a large port and each large port opposes a small port.

17. The method according to claim 16 wherein the small and large ports in said third set alternate with one another.

18. The method according to claim 17 wherein the small and large ports in said fourth sets alternate with one another.

19. The method according to claim 16 or 15 wherein the ports in said third set are pointed downwardly, horizontally, or slightly upwardly, and the ports in said fourth set are pointed downwardly, horizontally, or slightly upwardly, into the interior of the boiler furnace.

20. A method for introducing air at levels above the primary level, into a boiler furnace having four walls, said method comprising:

(a) introducing air through at least one first jet located at a given elevation on a first wall of the interior of the boiler furnace;

(b) introducing air substantially at said given elevation through at least one second jet located on a second wall of the interior of the boiler furnace opposed to the first wall;

(c) introducing substantially no air at substantially said given elevation through the remaining walls; wherein (d) said first and second jets are arranged in opposed pairs with each pair including a large jet and a small jet.

21. The method according to claim 20 wherein said first jets comprise a single large port and said second jets comprise a single small port that is opposed to said large port.

22. The method according to claim 20 wherein said first and second jets comprise single similarly sized ports and high pressure air is introduced into one of said ports and low pressure air is introduced into the other of said ports.

23. A method according to claim 20 wherein a large jet opposes a small jet and a small jet opposes a large jet in each pair.

24. The method according to claim 20 wherein said first and second jets comprise opposed sets of similarly sized ports and high pressure air is introduced into one port in each pair of ports and low pressure air is introduced into the opposed port in such pair.

25. The method according to claim 24 wherein ports in each set having high pressure air introduced therein alternate with ports in the same set having low pressure air introduced therein.

26. The method according to claim 20 wherein:

(a) said first jets comprise a first set of small and large ports;

(b) said second jets comprise a second set of small and large ports; and (c) the positions of the ports in said sets are arranged so that each small port opposes a large port and each large port opposes a small port.

27. The method according to claim 26 wherein the small and large ports in said first set alternate with one another.

28. The method according to claim 27 wherein the small and large ports in said second set alternate with one another.

29. The method according to claim 26 or 25 wherein the ports in said first set are pointed downwardly, horizontally, or slightly upwardly, and the ports in said second set are pointed downwardly, horizontally, or slightly upwardly, into the interior of the boiler furnace.

30. A method for introducing primary air at the lowest air flow elevation into a boiler furnace having four walls, said method comprising:

(a) introducing air through at least one first jet located at a given elevation on a first wall of the interior of the boiler furnace;

(b) introducing air at substantially said given elevation through at least one second jet located on a second wall of the interior of the boiler furnace opposed to the first wall;

(c) introducing substantially no air at substantially said given elevation through the remaining walls;

(d) wherein third and fourth pairs of opposed small and large jets are located at substantially common elevations in the boiler furnace higher than first and second jets.

31. The method according to claim 30 wherein said third jets comprise a single large port and said fourth jets comprise a single small port that is opposed to said large port.

32. The method according to claim 30 wherein said third and fourth jets comprise single similarly-sized ports and high pressure air is introduced into one of said ports and low pressure air is introduced into the other of said ports.

33. The method according to claim 30 wherein:

(a) said third jets comprise a third set of small and large ports;

(b) said fourth jets comprise a fourth set of small and large ports; and (c) the positions of the ports in said third and fourth sets are arranged so that each small port opposed a large port and each large port opposes a small port.

34. The method according to claim 33 wherein the small and large ports in said third set alternate with one another.

35. The method according to claim 34 wherein the small and large ports in said fourth set alternate with one another.

36. The method according to claim 30 wherein the third and fourth jets comprise opposed sets of similarly-sized ports and high pressure air is introduced into one port in each pair of ports in said sets and low pressure air is introduced into the opposed port in such pair.

37. The method according to claim 36 wherein each set has ports having high pressure air introduced therein alternating with ports in the same set having low pressure air introduced therein.

38. The method according to claim 33 or 37 wherein the ports in said third set are pointed downwardly, horizontally, or slightly upwardly, and the ports in said fourth set are pointed downwardly, horizontally, or slightly upwardly, into the interior of the boiler furnace.

* * * * *